US007671804B2

(12) United States Patent
Zhang et al.

(10) Patent No.: US 7,671,804 B2
(45) Date of Patent: Mar. 2, 2010

(54) TUNABLE ANTENNAS FOR HANDHELD DEVICES

(75) Inventors: Zhijun Zhang, Santa Clara, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 668 days.

(21) Appl. No.: 11/516,433

(22) Filed: Sep. 5, 2006

(65) Prior Publication Data

US 2008/0055164 A1 Mar. 6, 2008

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,832,372 | A | 11/1998 | Clelland et al. | |
| 6,034,636 | A * | 3/2000 | Saitoh | 343/700 MS |
| 6,414,641 | B1 * | 7/2002 | Carlson et al. | 343/702 |
| 6,423,915 | B1 | 7/2002 | Winter | |
| 6,504,507 | B2 | 1/2003 | Geeraert | |
| 6,650,295 | B2 | 11/2003 | Ollikainen et al. | |
| 6,714,162 | B1 | 3/2004 | Kadambi et al. | |
| 6,734,825 | B1 | 5/2004 | Guo et al. | |
| 6,762,723 | B2 | 7/2004 | Nallo et al. | |
| 6,836,249 | B2 | 12/2004 | Kenoun et al. | |
| 6,917,335 | B2 | 7/2005 | Kadambi et al. | |
| 6,933,893 | B2 | 8/2005 | Rubinshteyn et al. | |
| 6,950,065 | B2 | 9/2005 | Ying et al. | |
| 6,970,137 | B1 | 11/2005 | Maslovski et al. | |
| 7,079,079 | B2 | 7/2006 | Jo et al. | |
| 2004/0140933 | A1 * | 7/2004 | Shikata et al. | 343/700 MS |
| 2005/0151689 | A1 | 7/2005 | Vesterinen | |
| 2005/0280587 | A1 * | 12/2005 | Svigelj et al. | 343/702 |

FOREIGN PATENT DOCUMENTS

| | | |
|---|---|---|
| EP | 0 892 459 | 1/1999 |
| EP | 1 146 590 | 10/2001 |
| EP | 1 168 496 | 1/2002 |
| EP | 1 387 435 | 2/2004 |
| WO | 01/29927 | 4/2001 |

* cited by examiner

*Primary Examiner*—Tan Ho
(74) *Attorney, Agent, or Firm*—Treyz Law Group; G. Victor Treyz

(57) ABSTRACT

A compact tunable antenna for a handheld electronic device and methods for calibrating and using compact tunable antennas are provided. The antenna can have multiple ports. Each port can have an associated feed and ground. The antenna design can be implemented with a small footprint while covering a large bandwidth. The antenna can have a radiating element formed from a conductive structure such as a patch or helix. The antenna can be shaped to accommodate buttons and other components in the handheld device. The antenna may be connected to a printed circuit board in the handheld device using springs, pogo pins, and other suitable connecting structures. Radio-frequency switches and passive components such as duplexers and diplexers may be used to couple radio-frequency transceiver circuitry to the different feeds of the antenna. Antenna efficiency can be enhanced by avoiding the use of capacitive loading for antenna tuning.

11 Claims, 14 Drawing Sheets

TUNABLE ANTENNAS FOR HANDHELD DEVICES

BACKGROUND

This invention can relate to antennas, and more particularly, to compact tunable antennas used in wireless handheld electronic devices.

Wireless handheld devices, such as cellular telephones, contain antennas. As integrated circuit technology advances, handheld devices are shrinking in size. Small antennas are therefore needed.

A typical antenna for a handheld device is formed from a metal radiating element. The radiating element may be fabricated by patterning a metal layer on a circuit board substrate or may be formed from a sheet of thin metal using a foil stamping process. These techniques can be used to produce antennas that fit within the tight confines of a compact handheld device.

Modern handheld electronic devices often need to function over a number of different communications bands. For example, quad-band cellular telephones that use the popular global system for mobile (GSM) communications standard need to operate at four different frequencies (850 MHz, 900 MHz, 1800 MHz, and 1900 MHz).

Although multi-band operation is desirable, it is difficult to design a compact antenna that functions satisfactorily over a wide frequency range. This is because small antennas tend to operate over narrow frequency ranges due to the small dimensions of their radiating elements.

Antennas with tunable capacitive loading have been developed in an attempt to address the need for compact multi-band antennas. By varying the amount of capacitive loading that is applied to the radiating element, the resonant frequency of the antenna can be adjusted. This allows an antenna with a relatively narrow frequency range to be tuned sufficiently to cover more than one band.

The adjustable capacitive loading that is placed on this type of antenna leads to unwanted power loss. As a result, capacitively-tuned antennas tend to exhibit less-than-optimal efficiencies.

It would be desirable to be able to provide ways in which to improve the performance of tunable antennas for handheld electronic devices.

SUMMARY

In accordance with the present invention, tunable multiport antennas are provided. Handheld devices that use the tunable multiport antennas and methods for calibrating and using the tunable multiport antennas are also provided.

A tunable multiport antenna can have a ground terminal and multiple feed terminals. Each feed terminal can be used with the ground terminal to form a separate antenna port. By selecting which antenna port is active at a given time, the antenna's operating frequencies can be tuned.

Tunable multiport antennas contain radiating elements. The radiating elements may be formed, for example, by a foil stamping process or by patterning a conductive layer on a substrate such as a printed circuit board or flex circuit. Each radiating element can resonate at a fundamental frequency range. The dimensions of the radiating element may be chosen to align the antenna's fundamental operating frequency range with at least one communications band. If desired, the radiating element may also be used at one or more harmonic frequency ranges.

The radiating element can be coupled to a printed circuit board on which electronic components for a handheld electronic device are mounted. The printed circuit board can contain conductive traces that connect the components to the ground and feed terminals of the antenna. Electrical connecting structures, such as springs and spring-loaded pins, can be used to electrically connect the conductive traces on the printed circuit board to the ground and feeds of the radiating element.

Handheld electronic devices can contain radio-frequency transceivers and switching circuitry. The radio-frequency transceivers can have input-output paths that are used to transmit and receive signals associated with different communications bands. The switching circuitry can selectively connects the input-output paths to the ports of the antenna. During operation of a handheld electronic device, control circuitry on the device can direct the switching circuitry to activate a desired one of the antenna ports. By selecting which antenna port is active, the control circuitry can tune the antenna so that one or more of the antenna's operating frequency ranges aligns with one or more desired communications bands.

Because the antenna can be tuned, it is not necessary to enlarge the dimensions of the radiating element to broaden the bandwidth of the radiating element's resonant frequencies. This allows the antenna to be implemented with a small footprint. The use of multiple feeds in the radiating element permits tuning without the use of adjustable capacitive loading, which reduces reactive antenna losses and enhances antenna efficiency.

Further features of the invention, its nature and various advantages will be more apparent from the accompanying drawings and the following detailed description of the preferred embodiments.

DETAILED DESCRIPTION

The present invention can relate to tunable antennas for portable electronic devices, such as handheld electronic devices. The invention can also relate to portable devices that contain tunable antennas and to methods for testing and using such devices and antennas.

A tunable antenna in accordance with the invention can have a radiating element with multiple antenna feeds and a ground. The radiating element may be formed using any suitable antenna structure such as a patch antenna structure, a planar inverted-F antenna structure, a helical antenna structure, etc.

The portable electronic devices may be small portable computers such as those sometimes referred to as ultraportables. With one particularly suitable arrangement, the portable electronic devices are handheld electronic devices. The use of handheld devices is generally described herein as an example.

The handheld devices may be, for example, cellular telephones, media players with wireless communications capabilities, handheld computers (also sometimes called personal digital assistants), remote controllers, and handheld gaming devices. The handheld devices of the invention may also be hybrid devices that combine the functionality of multiple conventional devices. Examples of hybrid handheld devices include a cellular telephone that includes media player functionality, a gaming device that includes a wireless communications capability, a cellular telephone that includes games and email functions, and a handheld device that receives email, supports mobile telephone calls, and supports web browsing. These are merely illustrative examples. Any suitable device may include a tunable multi-feed antenna, if desired.

Figure 1:
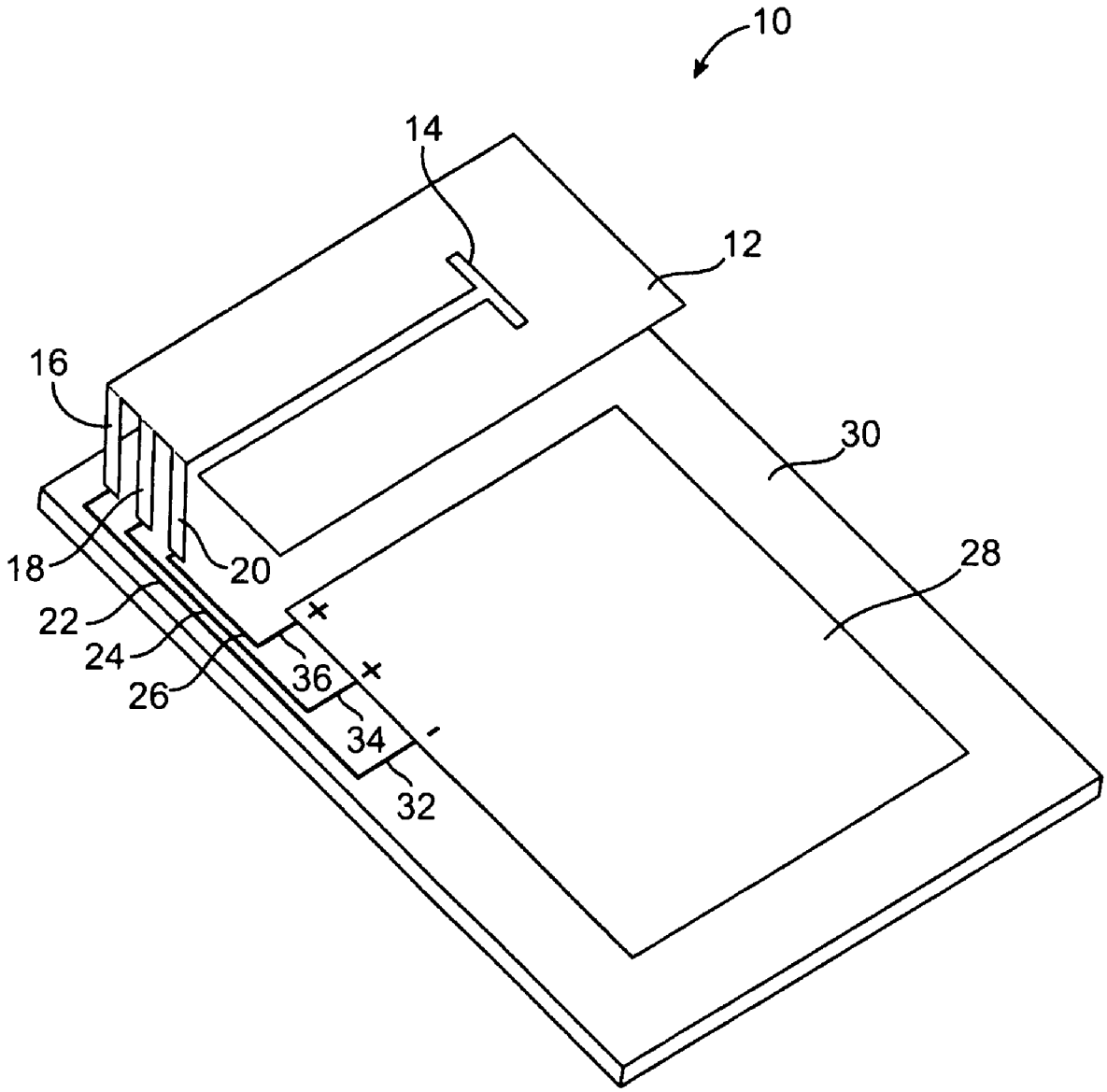
FIG. 1 is a perspective view of an illustrative circuit board to which a multi-port antenna is mounted in accordance with the present invention.

Illustrative antenna and control circuitry 10 that may be used in a handheld device in accordance with the invention is shown in FIG. 1. Circuitry 10 can include control circuitry 28. Control circuitry 28 may include one or more integrated circuits such as microprocessors, microcontrollers, digital signal processors, field programmable gate arrays, power amplifiers, and application-specific integrated circuits. Control circuitry 28 may also include passive RF components such as duplexers, diplexers, and filters.

Control circuitry 28 may be mounted to one or more printed circuit boards 30 or other suitable mounting structures. Circuit board 30 may be, for example, a dual-sided circuit board containing patterned conductive traces.

Control circuitry 28 can send and receive RF signals. The RF signals may be provided to an antenna module. The antenna module can contain a radiating element 12. Radiating element 12 may be formed from a highly-conductive material, such as copper, gold, alloys containing copper and other metals, high-conductivity non-metallic conductors (e.g., high-conductivity organic-based materials, high-conductivity superconductors, highly-conductive liquids), etc. In the example of FIG. 1, the radiating element 12 can have a thin planar profile, which facilitates placement of the radiating element 12 within a handheld device. The use of a radiating element with a planar structure is, however, merely illustrative. The radiating element 12 may be formed in any suitable shape.

In the FIG. 1 example, slot 14 can be formed in radiating element 12, which increases the effective length of the radiating element 12, while maintaining a compact footprint. Radiating element 12 may be formed using any suitable manufacturing technique. With one suitable arrangement, the so-called foil stamping method can be used to form radiating element 12. With foil stamping techniques, a foil stamping machine is used to generate numerous radiating elements from a thin copper foil. Another suitable technique for forming radiating element can involve printing or etching the antenna pattern onto a fixed or flexible substrate. Flexible substrates that may be used during these patterning processes include so-called flex circuits (e.g., circuits formed from metals such as copper that are layered on top of flexible substrates such as polyimide). If desired, other techniques may be used to form radiating elements 12.

The radiating element 12 can have a ground signal terminal and two or more corresponding positive signal terminals. The positive signal terminals can be called antenna feeds. In the example of FIG. 1, radiating element 12 can have three elongated portions 16, 18, and 20. Elongated portion 16 may serve as ground. Elongated portion 18 may serve as a first feed. Elongated portion 20 may serve as a second feed. In general, there may be any suitable number of feeds in the antenna (e.g., two feeds, three feeds, four feeds, more than four feeds, etc.).

Control circuitry 28 may include input-output terminals, such as ground input-output terminal 32 and positive input-output terminals 34 and 36. Conductive paths such as paths 22, 24, and 26 may be used to electrically connect the input-output terminals of control circuitry 28 to radiating element 12. Paths 22, 24, and 26 may be patterned conductive traces (e.g., metal traces) formed on printed circuit board 30. Paths 24 and 26 may be used to electrically connect positive input-output terminals 34 and 36 to elongated portions 18 and 20, respectively. A path such as path 22 may be used to connect the ground input-output terminal 32 to the ground portion 16 of radiating element 12. If desired, the upper and lower portions of printed circuit board 30 may also be connected to ground. The elongated portions 16, 18, and 20 may be soldered or otherwise electrically connected to paths 22, 24, and 26.

In the example of FIG. 1, the elongated portions 16, 18, and 20 are shown as being formed as an integral portion of radiating element 12 and paths 22, 24, and 26 are shown as being formed from circuit board traces. This is merely one suitable arrangement for connecting the ground and feeds of the radiating element 12 to the circuitry of the handheld device. Other suitable arrangement include contact arrangements based on external spring-loaded pins and spring connectors. Regardless of the particular type of arrangement that is used to convey signals into and out of the radiating element, the radiating element structure that is associated with ground is commonly referred to as the antenna's and radiating element's ground pin, ground terminal, or ground and the radiating element structure that is associated with positive antenna signals is commonly referred to as the antenna's and radiating element's feed pin, feed terminal, or feed.

The antenna formed from radiating element 14 has a resonant frequency $f_0$ at which it can transmit and receive signals. The operating frequency range surrounding $f_0$ is sometimes referred to as the fundamental band or fundamental operating frequency range of the antenna. If, as an example, $f_0$ is at 850 MHz, the antenna's fundamental frequency range can be used to cover a 850 MHz communications band. Antennas also generally resonate at higher frequencies that are harmonics of $f_0$. With this type of arrangement, an antenna can cover two or more bands. For example, an antenna may be designed to cover both the 850 MHz band (using the antenna's fundamental frequency range centered on $f_0$) and the 1800 MHz band (using a harmonic frequency range).

The bandwidth associated with an antenna's operating frequency is influenced by the geometry of the radiating element 12. Antennas that are compact tend to have narrow bandwidths. Unless the bandwidth of the antenna is widened (e.g., by increasing its physical size), the antenna will not be able to cover nearby bands without tuning.

As an example, consider the GSM cellular telephone standard, which uses bands at 850 MHz, 900 MHz, 1800 MHz, and 1900 MHz. These bands may have bandwidths of about 70-80 MHz (for the 850 MHz and 900 MHz bands), 170 MHz (for the 1800 MHz band), and 140 MHz (for the 1900 MHz band). Each band may contain two associated subbands for transmitting and receiving data. For example, in the 850 MHz band, a subband that extends from 824 to 849 MHz may be used for transmitting data from a cellular telephone to a base station and a subband that extends from 869 to 894 MHz may be used for receiving data from a base station. The 850 MHz and 1900 MHz bands may be used in countries such as the United States. The 900 MHz and 1800 MHz may be used in countries such as the European countries.

A compact antenna that is designed to cover the 850 MHz band may have a harmonic that allows it to simultaneously cover a higher band (e.g., 1900 MHz), but a compact antenna that has a narrow bandwidth will not be able to cover both the 850 MHz and 900 MHz bands unless it is tuned.

In accordance with the present invention, control circuitry 28 may be used to select between different feeds to tune the antenna formed from radiating element 12. When, for example, signals are transmitted or received using ground terminal 32 and input-output terminal 34, the antenna covers one band. When signals are transmitted on received using ground terminal 32 and input-output terminal 36, the antenna covers a different band.

Each feed (and its associated ground) may serve as an antenna port. An antenna such as an antenna formed from radiating element 12 of FIG. 1 therefore can have multiple ports and can be tuned by proper port selection. The control circuitry 28 can be used to determine which port is used. When access to a particular band is desired, the control circuitry 28 ensures that the proper port is active. By using multiple ports, a compact antenna with potentially narrow resonances can be tuned to cover all bands of interest.

Figure 2:
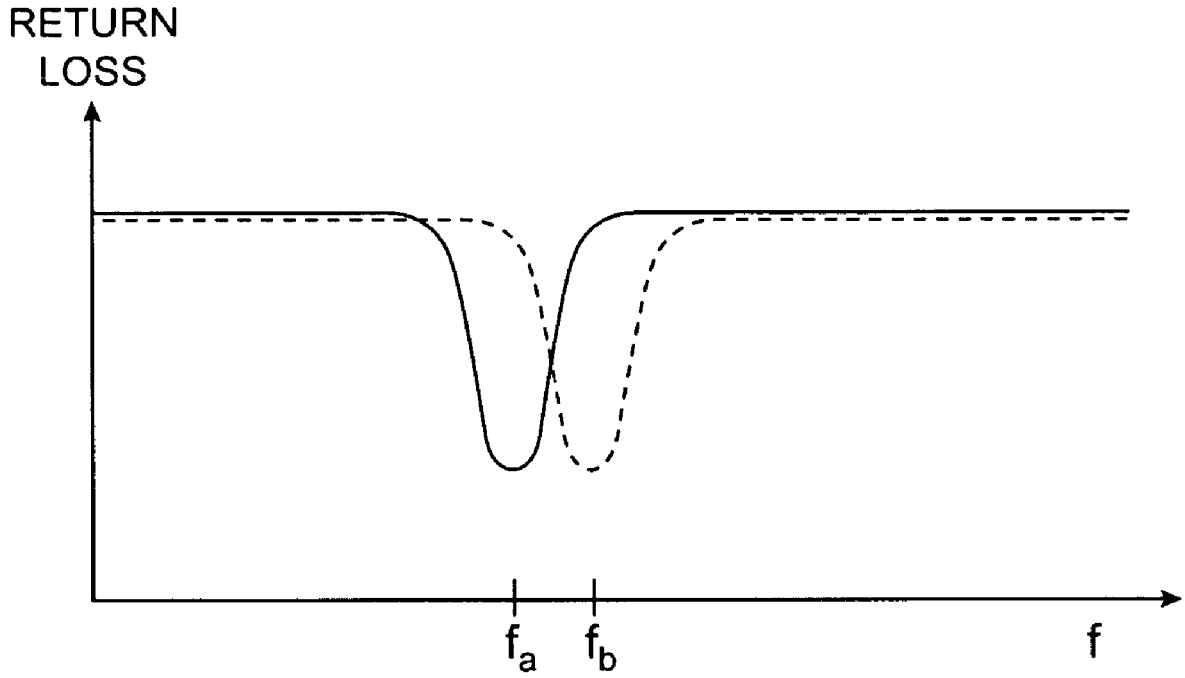
FIG. 2 is a graph in which the return loss of the antenna of FIG. 1 has been plotted as a function of frequency in accordance with the present invention.

A graph containing an illustrative plot of return loss versus frequency for a tunable multi-port antenna in accordance with the present invention is shown in FIG. 2. Return loss is at a minimum at the antenna's fundamental operating frequency range. No harmonic frequency ranges are shown in FIG. 2.

When signals are transmitted and received through a first antenna port (i.e., ground terminal 32, path 22, and radiating element extension 16 and positive input-output terminal 34, path 24, and radiating element extension 18), the antenna covers the frequency range centered at frequency $f_a$, as shown by the solid line in FIG. 2 When signals are transmitted and received through a second antenna port (i.e., ground terminal 32, path 22, and radiating element extension 16 and positive input-output terminal 36, path 26, and radiating element extension 20), the antenna covers the frequency range centered at frequency $f_b$, as shown by the dashed line in FIG. 2. This allows the control circuitry 28 to tune the antenna as needed. When it is desired to send or receive data in the $f_a$ range, the control circuitry 28 uses the first port. When the second port is used, the antenna's response is tuned to higher frequencies, so that the antenna covers a range of frequencies centered at $f_b$.

By using intelligent port selection, the coverage of an antenna can be extended to cover all frequency bands of interest. Because compact radiating elements tend to have small sizes, an antenna that is tuned by selecting a desired antenna port can be made more compact than would otherwise be possible, while still ensuring that all desired bands are covered. Moreover, tuning through the use of port selection can be more efficient than antenna tuning through adjustable capacitive loading schemes. Such capacitive loading schemes introduce reactive losses, which reduce antenna efficiency. An antenna with multiple feeds need not be tuned using variable capacitive loading because tuning can be performed through proper port selection.

Figure 3:
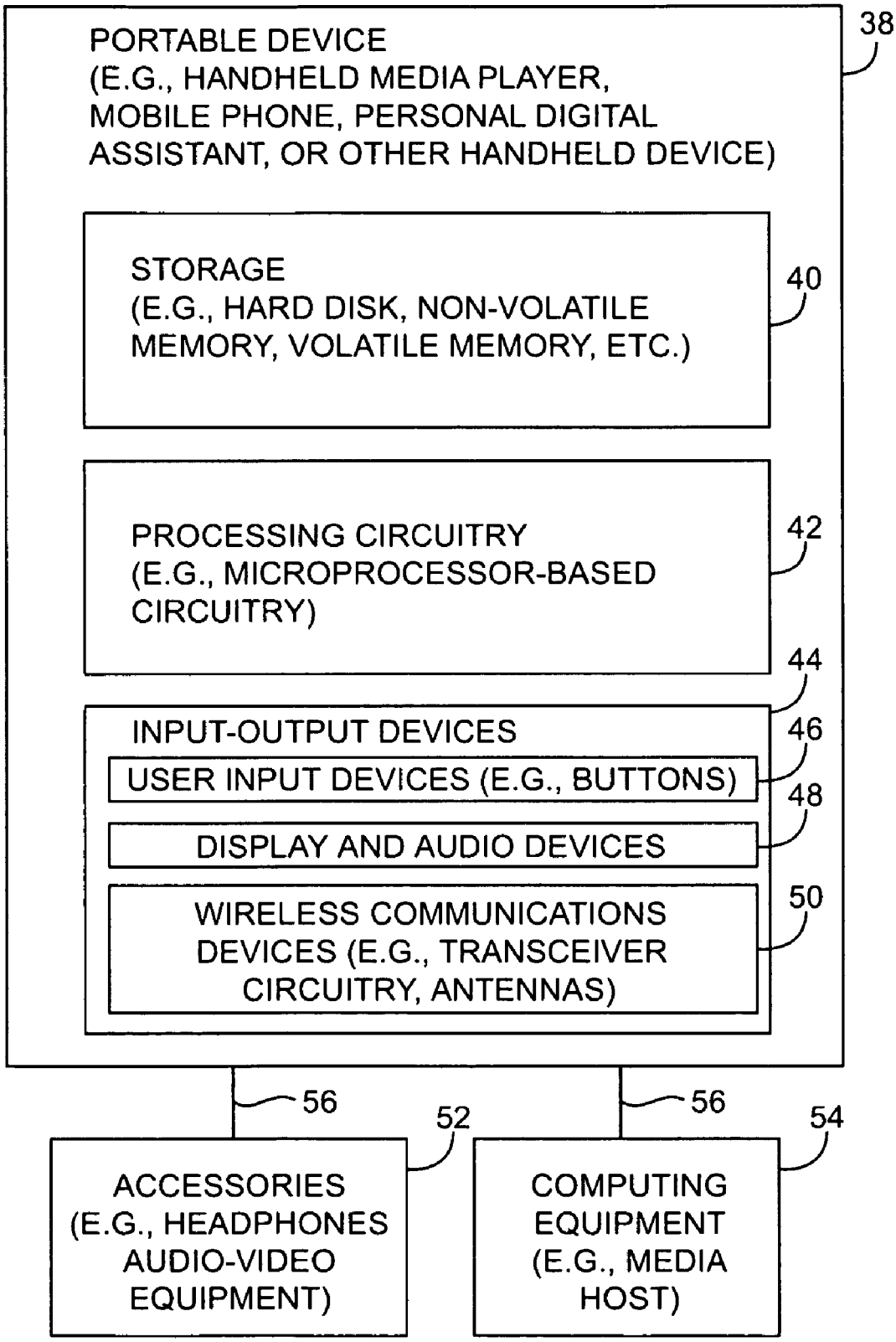
FIG. 3 is a schematic diagram of an illustrative handheld device containing a tunable antenna in accordance with the present invention.

A schematic diagram of an illustrative handheld electronic device 38 containing a tunable multi-port antenna is shown in FIG. 3. Handheld device 38 may be a mobile telephone, a mobile telephone with media player capabilities, a handheld computer, a game player, a combination of such devices, or any other suitable portable electronic device.

As shown in FIG. 3, handheld device 38 may include storage 40. Storage 40 may include one or more different types of storage such as hard disk drive storage, nonvolatile memory (e.g., FLASH or electrically-programmable-read-only memory), volatile memory (e.g., battery-based static or dynamic random-access-memory), etc.

Processing circuitry 42 may be used to control the operation of device 38. Processing circuitry 42 may be based on a processor such as a microprocessor and other suitable integrated circuits.

Input-output devices 44 may allow data to be supplied to device 38 and may allow data to be provided from device 38 to external devices. Input-output devices can include user input-output devices 46 such as buttons, touch screens, joysticks, click wheels, scrolling wheels, touch pads, key pads, keyboards, microphones, cameras, etc. A user can control the operation of device 38 by supplying commands through user input devices 46. Display and audio devices 48 may include liquid-crystal display (LCD) screens, light-emitting diodes (LEDs), and other components that present visual information and status data. Display and audio devices 48 may also include audio equipment such as speakers and other devices for creating sound. Display and audio devices 48 may contain audio-video interface equipment such as jacks for external headphones and monitors.

Wireless communications devices 50 may include communications circuitry such as RF transceiver circuitry formed from one or more integrated circuits, power amplifier circuitry, passive RF components, antennas such as the multi-port antenna of FIG. 1, and other circuitry for generating RF wireless signals. Wireless signals can also be sent using light (e.g., using infrared communications).

The device 38 can communicate with external devices such as accessories 52 and computing equipment 54, as shown by paths 56. Paths 56 may include wired and wireless paths. Accessories 52 may include headphones (e.g., a wireless cellular headset or audio headphones) and audio-video equipment (e.g., wireless speakers, a game controller, or other equipment that receives and plays audio and video content). Computing equipment 54 may be a server from which songs, videos, or other media are downloaded over a cellular telephone link or other wireless link. Computing equipment 54 may also be a local host (e.g., a user's own personal computer), from which the user obtains a wireless download of music or other media files.

Figure 4:
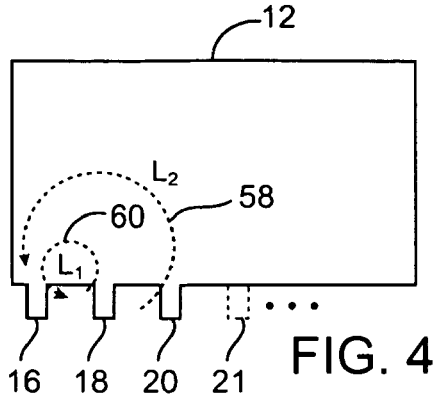
FIGS. 4-14 are diagrams of illustrative antenna radiating elements having multiple feeds that can be selected for tuning in accordance with the present invention.

As described in connection with FIG. 1, the multiport antenna used in the handheld device can be formed from any suitable radiating element 12. An example of a radiating element 12 that is formed from a rectangular patch antenna structure is shown in FIG. 4. The antenna structure of FIG. 4 and the other radiating element structures are preferably about one quarter of a wavelength in size (e.g., several centimeters for most cellular telephone wavelengths).

The radiating element 12 of FIG. 4 may have a ground terminal 16, a first feed 18, a second feed 20, and potentially more feeds (shown by dotted feed structure 21). In general, any radiating element 12 may have more than two feeds, but only the radiating element 12 of FIG. 4 shows the additional feeds to avoid over-complicating the drawings.

Different fundamental resonant frequencies are associated with each of the different antenna ports and are influenced by the geometry of the radiating element 12. As shown in FIG. 4, when feed 18 is used, there is an inductive path in the antenna between feed 18 and ground 16. This path is shown schematically by dotted line 60. When feed 20 is used, there is a different inductive path in the antenna, shown by dotted line 58. Inductances $L_1$ and $L_2$ are associated with paths 60 and 58, respectively. The inductance $L_2$ is generally larger than the inductance $L_1$, so the port formed using feed 20 resonates at a higher frequency (e.g., frequency $f_b$ of FIG. 2) than the port formed using feed 18 (e.g., frequency $f_a$ of FIG. 2).

Figure 5:
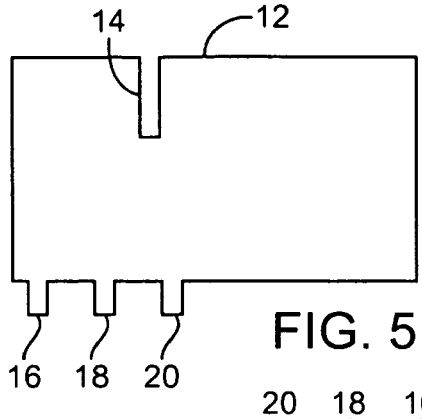

An illustrative radiating element 12 that is formed from a rectangular patch antenna structure containing a slot 14 is shown in FIG. 5. Because of the presence of slot 14, the antenna of FIG. 5 will exhibit harmonics that are shifted with respect to the harmonics of the patch antenna structure of FIG. 4. This allows the antenna designer to place harmonics at desired communications bands.

Figure 6:
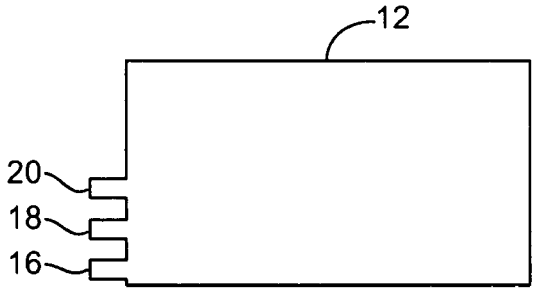

If desired, antenna ports may be formed on the shorter side of a rectangular patch. An illustrative structure of the type shown in FIG. 1 in which feeds have been placed on the shorter size of the rectangular patch is shown in FIG. 6.

Figure 7:
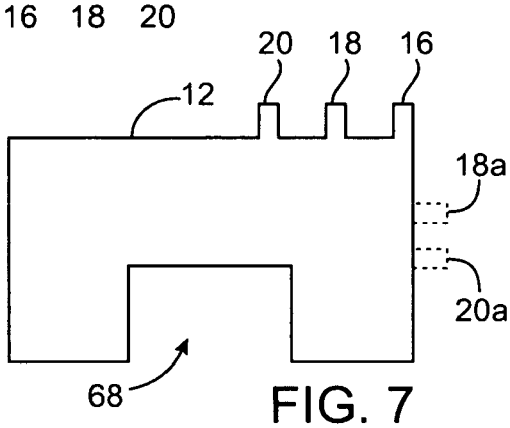
Figure 8:
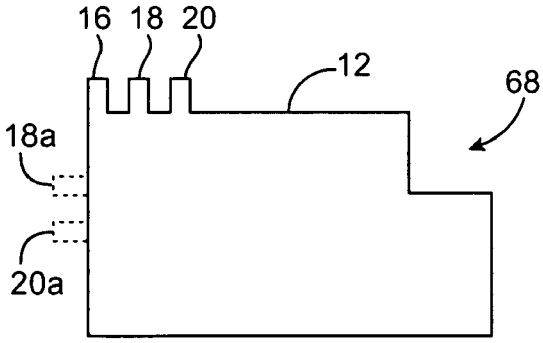

Another illustrative radiating element 12 is shown in FIG. 7. With the arrangement of FIG. 7, the rectangular patch structure has a cut-away portion 68. The cut-away portion 68 may be formed to accommodate a cellular telephone camera, a button, a microphone, speaker, or other component of the handheld device. Ports may be formed on the long side of the element 12 (e.g., using ground 16 and feeds 18 and 20) or on the short side of element 12 (e.g., using ground 16 and feeds 18*a* and 20*a*). As shown in FIG. 8, the cut-away portion 68 need not be formed in the center of the radiating element 12.

Figure 9:
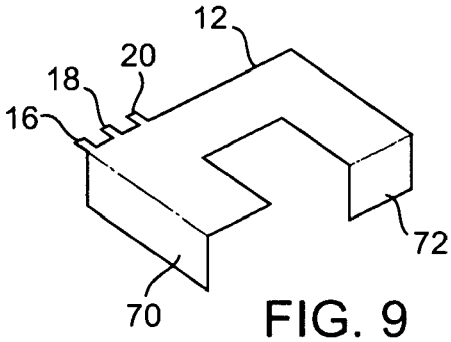

FIG. 9 shows how the sides of a radiating element may be bent downwards. Portions of the radiating element 12 such as portions 70 and 72 may be formed during a foil stamping process or by using a flex circuit. Portions 70 and 72 may serve as a fixed source of capacitive loading. Using bent-down portions in this type of arrangement tends to decrease the footprint of the radiating element for a given operating frequency. If desired, other forms of capacitive loading may be used with radiating element. Capacitive loading can be used with the patch antenna structure of FIG. 7 (as shown in the example of FIG. 9) or with any other suitable radiating element structure.

Figure 10:
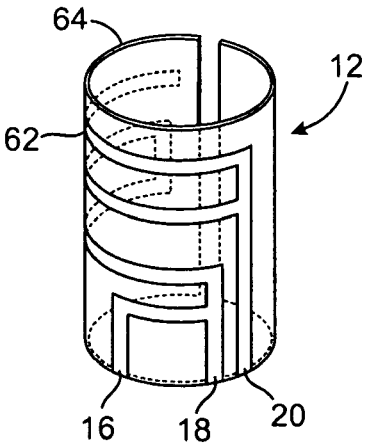

If desired, a radiating element 12 may be formed from a flex circuit or other flexible substrate. In the example of FIG. 10, radiating element 12 is formed from a conductive element 62 that is formed in a serpentine pattern on flex circuit substrate 64. After the serpentine pattern is formed on substrate 64, the substrate 64 is curled to form the cylindrical shape of FIG. 10. The cylindrical antenna of FIG. 10 has a ground 16 and two feeds 18 and 20.

Figure 11:
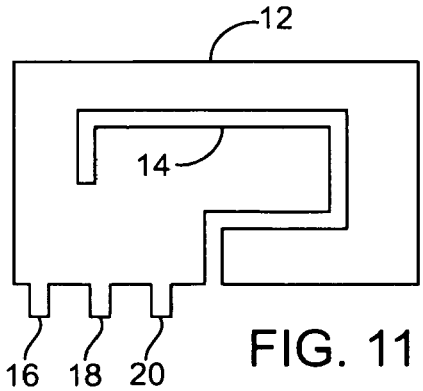

In the illustrative arrangement of FIG. 11, radiating element 12 is formed from a patch antenna having a serpentine slot 14. In general, one or more slots of any suitable shape may be formed in the radiating element 12.

Figure 12:
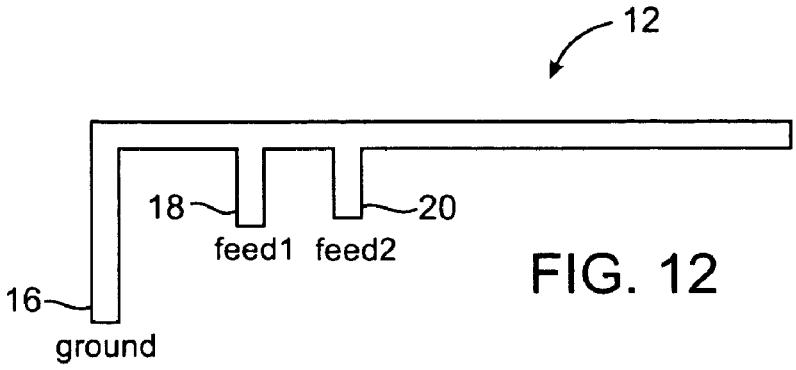

FIG. 12 shows an illustrative arrangement for a radiating element 12 that is based on an L-shaped planar antenna arrangement. The radiating element 12 of FIG. 12 has a ground 16 and feeds 18 and 20.

Figure 13:
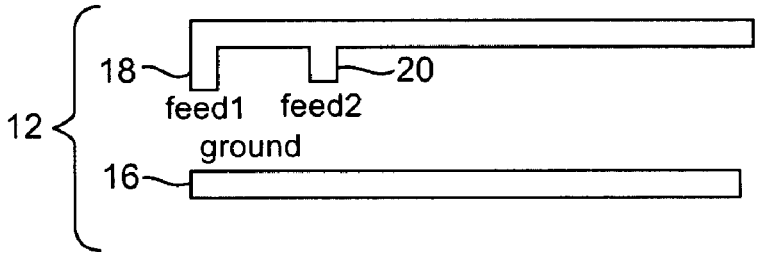

In FIG. 13, the ground terminal 16 is formed using a separate conductor from the conductive element that contains feeds 18 and 20.

Figure 14:
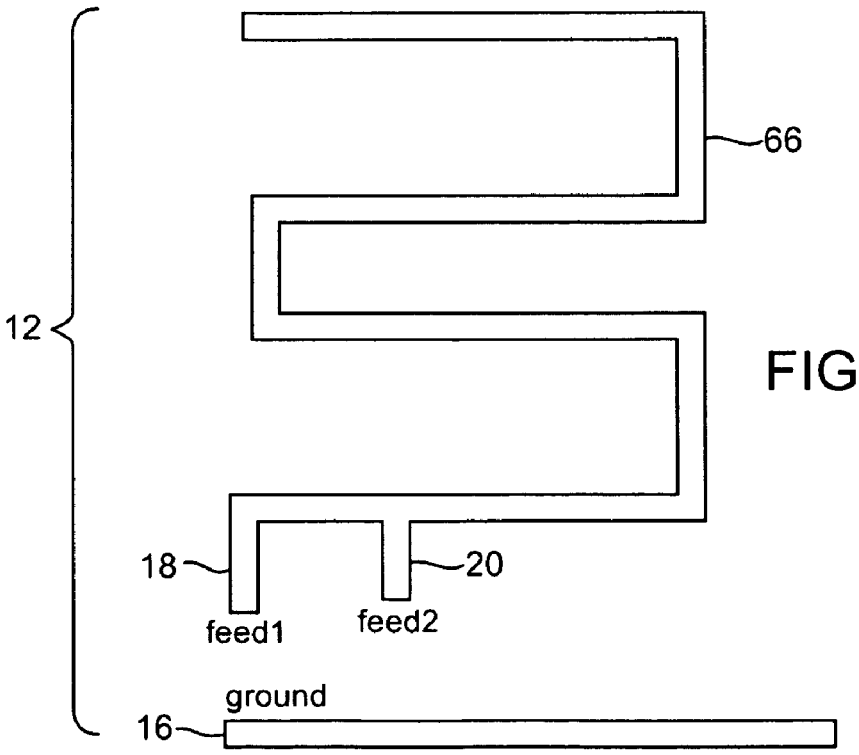

FIG. 14 shows an illustrative radiating element 12 that is formed from a separate ground element 16 and serpentine element 66. Feeds 18 and 20 are formed at different locations in the serpentine element 66.

The radiating element structures show in FIGS. 1 and 4-14 are merely illustrative. In general, any suitable radiating element structures with multiple feeds may be used.

Figure 15:
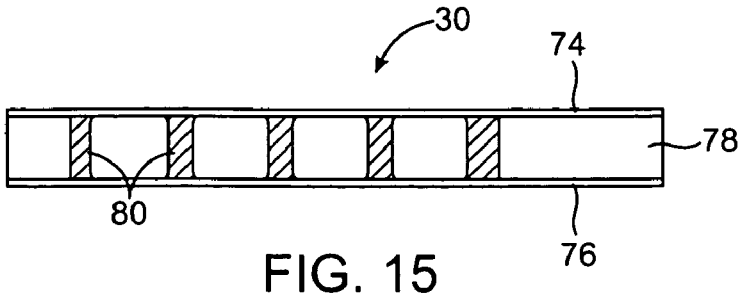
FIG. 15 is a side view of an illustrative printed circuit board showing how vias can be used to connect the upper and lower surfaces of the printed circuit board to form a ground plane for an antenna of the type show in FIG. 1 in accordance with the present invention.

As shown in FIG. 15, a printed circuit board such as printed circuit board 30 of FIG. 1 may have an upper surface of conductive material 74 and a lower surface of conductive material 76 separated by an insulating printed circuit board layer 78. The upper and lower conductive surfaces may contain a patterned metal such as copper. The lower surface may be relatively unpatterned and may be used to form a ground plane. Ground wires on the upper surface may be connected to the lower surface ground plane using conductive vias 80. When mounting the radiating element 12 to the printed circuit board 30, the patterned conductors on the upper surface of printed circuit board 30 may be used to form electrical contact with the radiating element.

Figure 16:
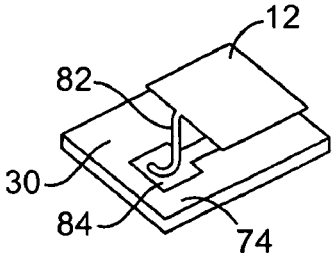
FIG. 16 is a perspective view of an illustrative portion of a circuit board assembly showing how a radiating element with an integral spring may be used to make contact between to a pad on a printed circuit board of the type shown in FIG. 15 in accordance with the present invention.

Electrical contact may be made using any suitable electrical connecting structures. In the example of FIG. 16, an elongated portion of radiating element 12 (e.g., a ground or feed element of the type shown in FIG. 1) is shown as forming a spring 82. When the antenna is mounted in proximity to the circuit board, the spring portion 82 presses against a conductive trace 84 on the upper surface 74 of circuit board 30. This forms an electrical contact between trace 84 (which is connected to control circuitry 28 of FIG. 1) and the radiating element 12.

Figure 17:
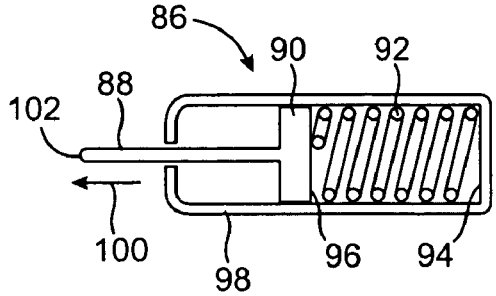
FIG. 17 is a cross-sectional side view of an illustrative spring-loaded pin that may be used to connect an antenna's radiating element to a circuit board in accordance with the present invention.

If desired, spring-loaded pins may be used to make electrical contact between a radiating element 12 and circuit board 30. One commonly-available spring-loaded pin is the so-called pogo pin. A cross-sectional side view of a spring-loaded pin 86 is shown in FIG. 17. Pin 86 has a reciprocating member 88 with a head portion 90 that reciprocates within a hollow cylindrical pin housing 98. A spring 92 bears against the inner surface 94 of pin housing 98 and the upper surface 96 of head 90. When member 88 is withdrawn within housing 98, spring 92 is compressed and biases reciprocating member 88 in direction 100. This drives the tip 102 of member 88 against a conductive element such as a portion of a circuit board or a radiating element.

Figure 18:
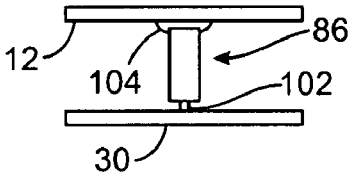
FIG. 18 is a cross-sectional side view showing use of an illustrative spring-loaded pin that is soldered to a radiating element to make contact with a printed circuit board in accordance with the present invention.

FIG. 18 shows an arrangement in which a spring-loaded pin 86 has been soldered to a radiating element 12 with solder 104. The tip 102 of the pin presses against a conductor on the surface of circuit board 30.

Figure 19:
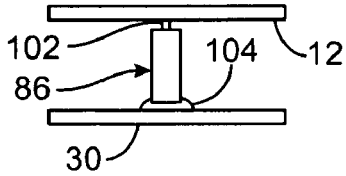
FIG. 19 is a cross-sectional side view showing use of an illustrative spring-loaded pin that is soldered to a printed circuit board to make contact with an antenna's radiating element in accordance with the present invention.

In the arrangement of FIG. 19, the spring-loaded pin 86 has been soldered to a circuit board 30 and is pressing upward against the radiating element 12, so that the tip 102 of reciprocating member 88 makes electrical contact with the radiating element.

Figure 20:
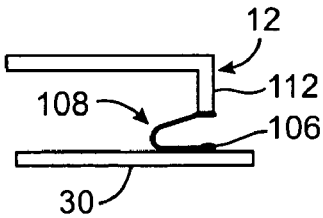
FIG. 20 is a cross-sectional side view showing use of an illustrative spring to make contact between a radiating element and a printed circuit board in accordance with the present invention.

FIG. 20 shows an arrangement in which a spring 108 has been soldered to a circuit board 30 with solder 106. A portion 112 of radiating element 12 has been bent downward. The portion 112 of radiating element 12 may be formed during a metal foil stamping process (as an example). As shown in FIG. 20, spring 108 is compressed and bears against the portion 112, thereby forming electrical contact between radiating element 12 and circuit board 30.

Figure 21:
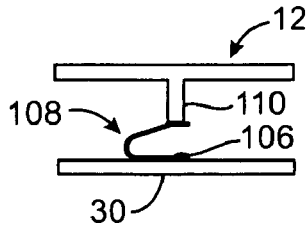
FIG. 21 is a cross-sectional side view showing use of an illustrative spring that is attached to a printed circuit board to make contact with a post of a radiating element formed from flexible circuit board material in accordance with the present invention.

The arrangement of FIG. 21 is similar to the arrangement of FIG. 20, but involves forming an electrical connection to a radiating element 12 that is fabricated from a flex circuit. The radiating element 12 has a post 110. As shown in FIG. 21, a spring 108 that has been soldered to circuit board 30 with solder 106 bears against post 110 to form electrical contact.

Figure 22:
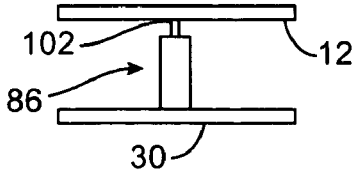
FIGS. 22 and 23 are cross-sectional side views showing use of an illustrative floating spring-loaded pin to make contact between a radiating element and a printed circuit board in accordance with the present invention.
Figure 23:
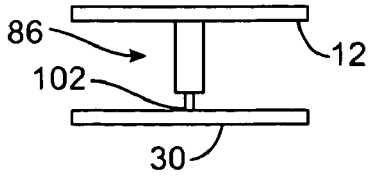

The pins and springs of FIGS. 18, 19, 20, and 21 need not be soldered to the circuit board or radiating element 12. Arrangements in which the connecting electrical structure is not soldered are said to be floating. FIGS. 22 and 23 show floating pin arrangements in which pin 86 forms an electrical connection between radiating element 12 and circuit board 30. In the arrangement of FIG. 22, the tip 102 of pin 86 presses against the radiating element 12. In the arrangement of FIG. 23, the tip 102 of pin 86 presses downward against a conductor on circuit board 30.

Any suitable circuit architecture may be used to interconnect the control circuitry 28 with the feeds of the antenna and radiating element 12.

Figure 24:
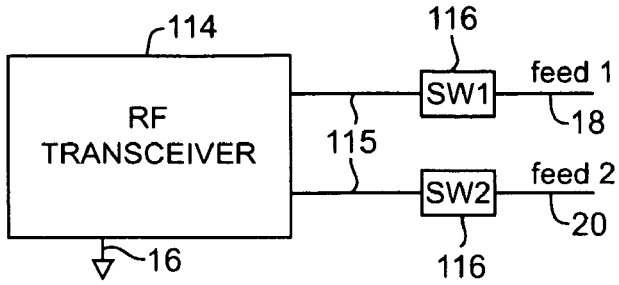
FIG. 24 is a circuit diagram showing how illustrative switches may be used to selectively connect a radio-frequency (RF) transceiver integrated circuit operating in two frequency bands to two different antenna feeds in accordance with the present invention.

Consider, as an example, the arrangement of FIG. 24. As shown in FIG. 24, an RF transceiver integrated circuit 114 is connected to ground 16. RF transceiver integrated circuit 114 is also connected to two antenna feeds 18 and 20 using input-output data paths 115 and switching circuitry formed from switches 116. Switches 116 may be formed from PIN diodes, high-speed field-effect transistors (FETs), or any other suitable switch components. The switches for each feed are complementary and work in tandem. The state of each switch is the inverse of the other. When switch SW1 is on, switch SW2 is off and a first antenna port is active while a second antenna port is inactive. When switch SW1 is off, switch SW2 is on and the first antenna port is inactive while the second antenna port is active. Using this type of arrangement ensures that only one feed is active at a time. Feed1 is active and feed2 is inactive when switch SW1 is on and switch SW2 is off. Feed2 is active and feed1 is inactive when switch SW2 is on and switch SW1 is off.

Figure 25:
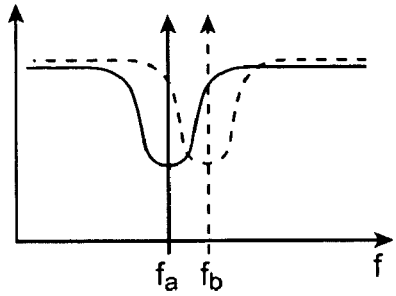
FIG. 25 is a graph showing the return loss of an illustrative radiating element versus frequency as the circuitry of FIG. 24 selects between each of two different antenna feeds on the radiating element in accordance with the present invention.

The graph of FIG. 25 shows the frequency response of the radiating element 12 in two conditions. The solid line shows the return loss of the radiating element at its fundamental operating frequency range when the first port is active. In this configuration, the antenna is tuned so that it operates at the frequency $f_a$. The dashed line in FIG. 25 shows the return loss of the radiating element when the second port is active. In this configuration, the antenna is tuned so that it operates at frequency $f_b$.

Figure 26:
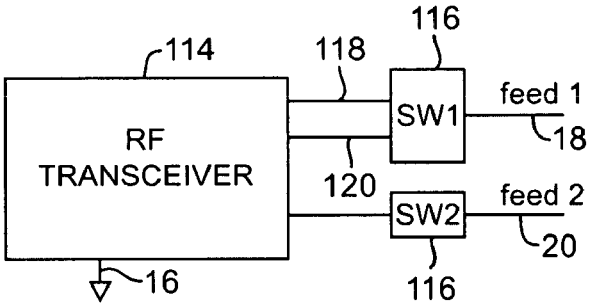
FIG. 26 is a circuit diagram showing how illustrative switches may be used to selectively connect a radio-frequency (RF) transceiver integrated circuit operating in three frequency bands to two different antenna feeds in accordance with the present invention.
Figure 27:
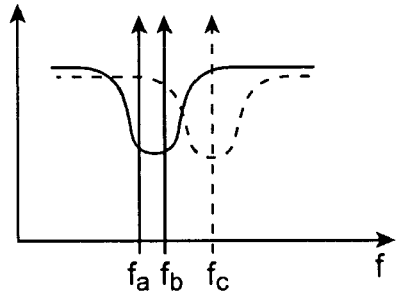
FIG. 27 is a graph showing the return loss of an illustrative radiating element versus frequency as the circuitry of FIG. 26 selects between each of two different antenna feeds on the radiating element in accordance with the present invention.

In the arrangement of FIG. 26, switch SW1 may handle two different bands ($f_a$ and $f_b$), whereas switch SW2 may handle frequency band $f_c$. Switch SW1 has three states. In its first state, input-output signal path 118 is connected to feed1 and the antenna operates at frequency $f_a$, as shown in FIG. 27. In its second state, input-output signal path 120 is connected to feed1 and the antenna operates in band $f_b$. As described in connection with FIG. 24, switch SW2 is off whenever switch SW1 is on. When it is desired to tune the antenna, the control circuitry 28 places switch SW1 in a third state in which lines 118 and 120 are disconnected from feed1 (i.e., switch SW1 is off). When switch SW1 is turned off, switch SW2 is turned on, so the antenna operates at shifted fundamental frequency $f_c$ (FIG. 27).

Figure 28:
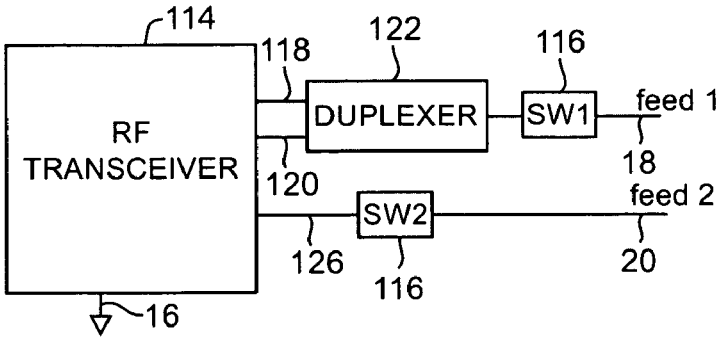
FIG. 28 is a circuit diagram showing how illustrative switches and a passive antenna duplexer may be used to selectively connect a radio-frequency (RF) transceiver integrated circuit operating in three frequency bands to two different antenna feeds in accordance with the present invention.
Figure 29:
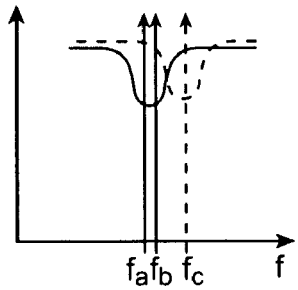
FIG. 29 is a graph showing the return loss of an illustrative radiating element versus frequency as the circuitry of FIG. 28 selects between each of two different antenna feeds on the radiating element in accordance with the present invention.

As shown in FIGS. 28 and 29, passive RF components such as duplexers and diplexers may be used to couple RF transceiver 114 to the antenna feeds. A duplexer can be used to combine or separate RF signals that are in adjacent bands (e.g., 850 MHz and 900 MHz). A diplexer can be used to combine or separate RF signals that are in distant bands (e.g., 850 MHz and 1800 MHz).

As shown in FIG. 28, duplexer 122 may be coupled between data paths 118 and 120 and switch SW1. Switch SW2 is coupled between data path 126 and feed2. When it is desired to use feed1, switch SW1 is turned on and switch SW2 is turned off. This tunes the antenna so that it operates according to the solid line of FIG. 29. In this state, RF transceiver 114 can use paths 118 and 120 to transmit and receive in either frequency band $f_a$ or frequency band $f_b$, because the radiating element 12 of the antenna is designed to have a sufficiently large bandwidth in its fundamental operating frequency range to handle the adjacent bands $f_a$ and $f_b$. When it is desired to tune the antenna by using feed2, switch SW1 is turned off and switch SW2 is turned on. In this state, path 126 is connected to feed2 and transceiver 114 can transmit and receive signals using band $f_c$, as shown by the dotted line in FIG. 29.

Figure 30:
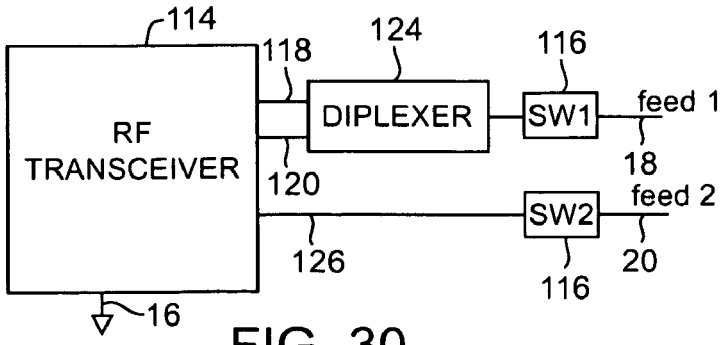
FIG. 30 is a circuit diagram showing how illustrative switches and a passive antenna diplexer may be used to selectively connect a radio-frequency (RF) transceiver integrated circuit operating in three frequency bands to two different antenna feeds in accordance with the present invention.
Figure 31:
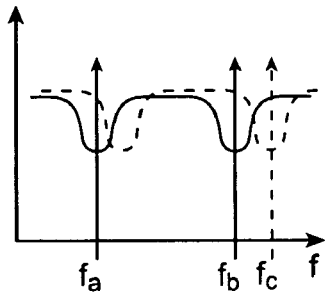
FIG. 31 is a graph showing the return loss of an illustrative radiating element versus frequency as the circuitry of FIG. 30 selects between each of two different antenna feeds on the radiating element in accordance with the present invention.

In the arrangement of FIG. 30, a diplexer 124 is used in place of a duplexer. The radiating element 12 in this scenario is designed to have a harmonic at $f_b$. Because a diplexer 124 is being used, the signals associated with paths 118 and 120 must be more widely separated than in the duplexer arrangement of FIG. 28. As shown by the solid line in FIG. 31, when feed1 is switched into use by turning on SW1 and turning off SW2, transceiver 114 can use paths 118 and 120 to transmit and receive in either fundamental frequency band $f_a$ or harmonic frequency band $f_b$. When it is desired to tune the antenna by using feed2, switch SW1 is turned off and switch SW2 is turned on. In this state, path 126 is connected to feed2 and transceiver 114 can transmit and receive signals using band $f_c$, as shown by the dotted line in FIG. 31.

Figure 32:
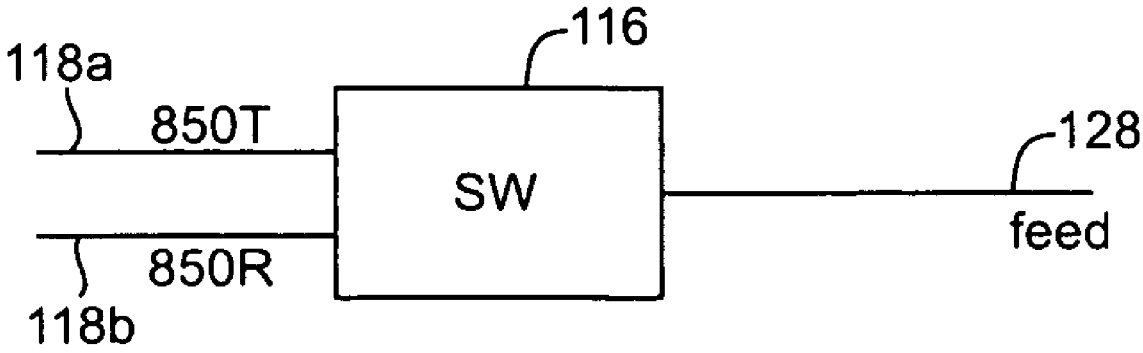
FIG. 32 is a diagram showing how transmitting and receiving subbands may be coupled to an antenna feed using an illustrative switch in accordance with the present invention.

The bands used in GSM communications each have two subbands, one of which contains channels for transmitting data and the other of which contains channels for receiving data. As shown in FIG. 32, a switch 116 can be used to connect an appropriate transmit or receive data path to its associated feed 128. Paths 118*a* and 118*b* are connected to the RF transceiver. In GSM communications, signals are either transmitted or are received. Simultaneous transmission and reception is not permitted. When the RF transceiver has data to transmit, switch 116 connects the transmit line 118*a* to feed 128. In receive mode, the switch 116 is directed to connect feed 128 to path 118*b*. When it is desired to inactivate the feed 128, switch 116 may be turned off. In the example of FIG. 32, paths 118*a* and 118*b* are labeled 850T (850 MHz transmit) and 850R (850 MHz receive). The same principal applies to all GSM bands. The input-output data paths connected to the RF transmitter 114 in FIGS. 24, 26, 28, and 30 are shown as single bidirectional paths rather than as separate transmit and receive paths to avoid over-complicating the drawings.

Figure 33:
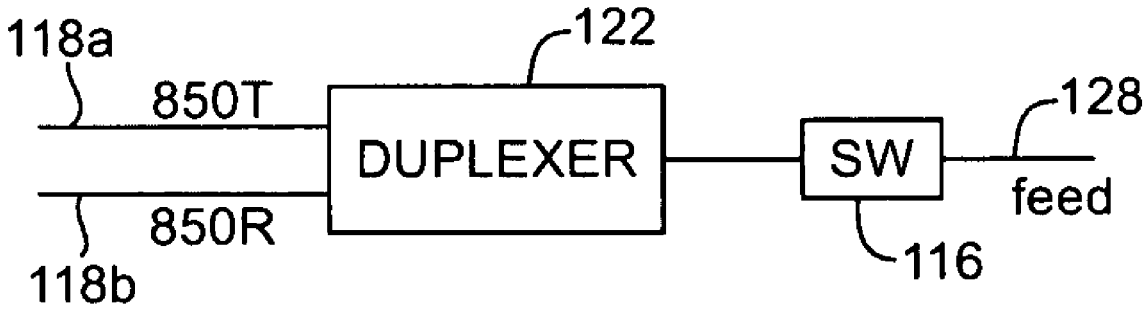
FIG. 33 is a diagram showing how transmitting and receiving subbands may be coupled to an antenna feed using an illustrative duplexer in accordance with the present invention.

An arrangement in which a duplexer 122 may be used to couple an RF transceiver to a feed 128 is shown in FIG. 33. When incoming data is received on feed 128 or when outgoing data is being transmitted, switch 116 is on. Switch 116 is off when it is desired to tune the antenna by using a different feed. Duplexer 122 is frequency sensitive. Incoming data (e.g., on the 850R subband) is routed to line 118*b* by the passive RF components in duplexer 122. When outgoing data is transmitted on line 118*a*, duplexer 122 routes those signals to line 128 via switch 116.

When architectures of the type shown in FIGS. 24, 26, 28, and 30 are used for GSM-type communications, an active subband switching arrangement of the type shown in FIG. 32 or a passive subband routing arrangement of the type shown in FIG. 33 may be used. In either case, switching circuitry 116 is used to ensure that the appropriate antenna feed is active.

In some communications protocols such as those based on code division multiple access (CDMA) technology, signals can be transmitted and received simultaneously. There is therefore no need for a switch to actively switch between transmit and receive bands. Examples of communications schemes that use CDMA technology include CDMA cellular telephone communications and 3G data communications over the 2170 MHz band (commonly referred to as UMTS or Universal Mobile Telecommunications System). With CDMA-based arrangements, a duplexer arrangement of the type shown in FIG. 33 may be used to separate transmitting and receiving frequencies from each other.

Figure 34:
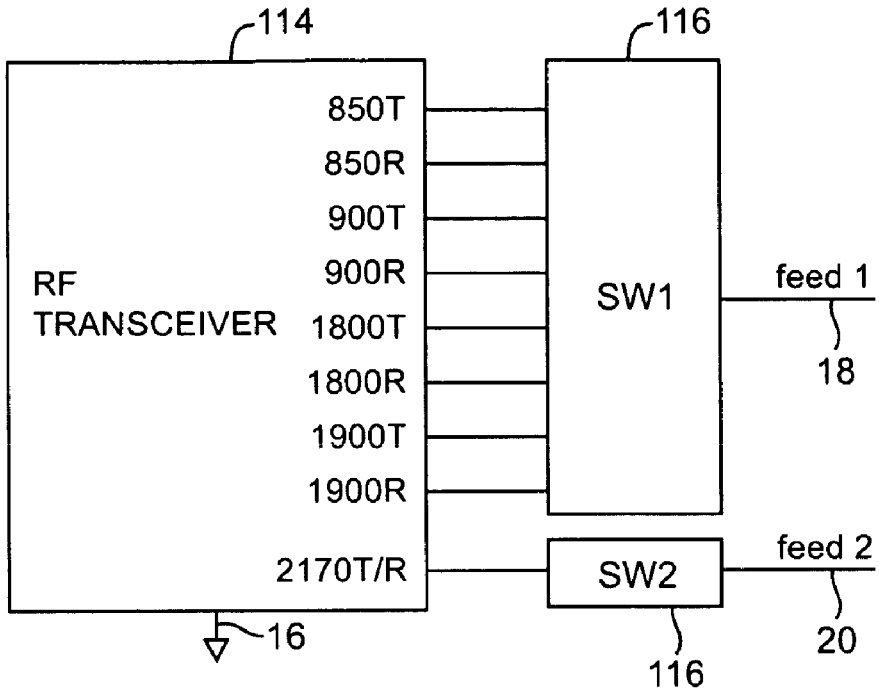
FIG. 34 is a diagram showing how an illustrative RF transceiver integrated circuit with five bands can be selectively connected to two different antenna feeds using switching circuitry made up of two switches in accordance with the present invention.
Figure 35:
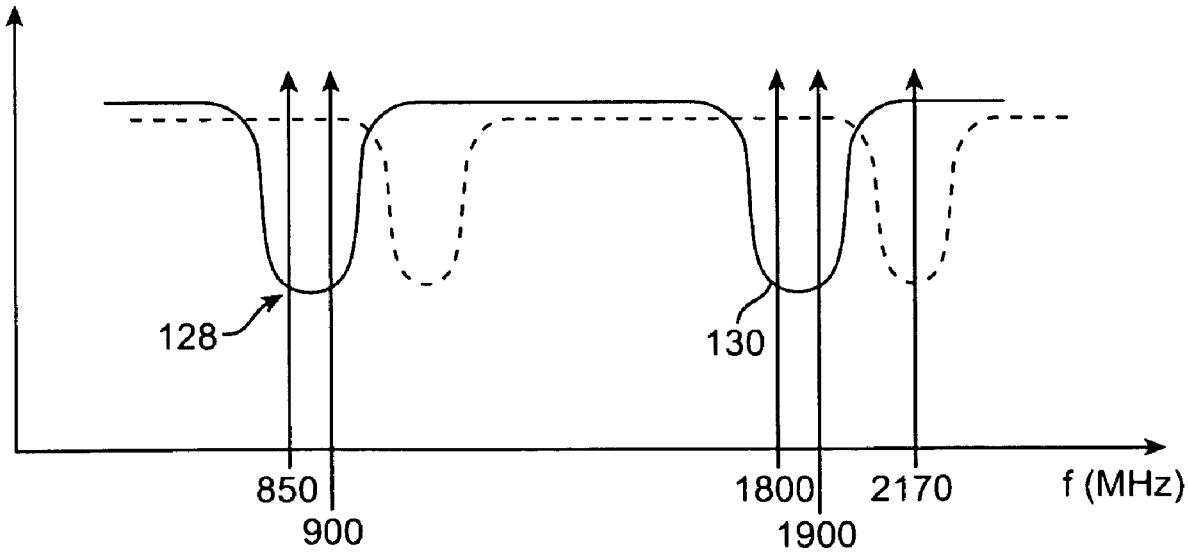
FIG. 35 is a diagram showing the return loss of an illustrative radiating element versus frequency as the circuitry of FIG. 34 selects between each of the two different antenna feeds in accordance with the present invention.

Some handheld devices need to cover many bands. An example of an arrangement that may be used to cover five bands (e.g., the four GSM bands plus the UMTS band) using a two port antenna is shown in FIG. 34. A graph showing the placement of each of the bands is shown in FIG. 35. The antenna is designed to have a fundamental operating frequency range 128 at about 850-900 MHz and a harmonic operating frequency range 130 at about 1800-1900. When switch SW1 is on and switch SW2 is off, feed1 is active and the antenna's response is as shown by the solid line in FIG. 35. The antenna is designed to have a relatively broad bandwidth at its fundamental and harmonic operating frequencies. As a result, the antenna covers both the 850 MHz and 900 MHz GSM bands in the fundamental operating frequency range 128 and covers both the 1800 MHz and 1900 MHz GSM bands using the harmonic operating frequency range 130. When switch SW2 is on and switch SW1 is off, feed 2 is active and the antenna is tuned. This shifts the harmonic operating frequency range 130 to a higher frequency, so that it covers the UMTS band at 2170 MHz.

Figure 36:
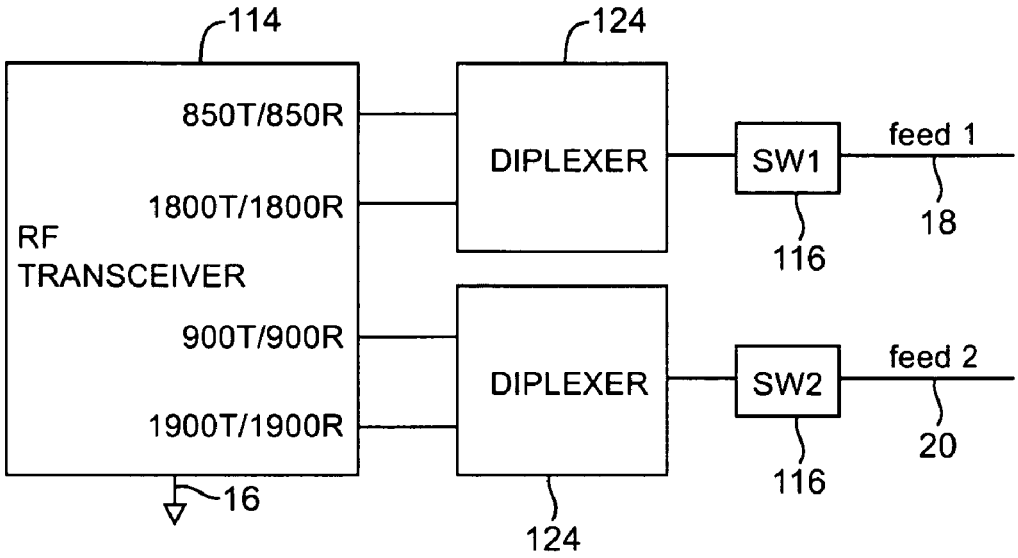
FIG. 36 is a diagram showing how an illustrative RF transceiver integrated circuit with four bands can be selectively connected to two different antenna feeds using two diplexers in accordance with the present invention.
Figure 37:
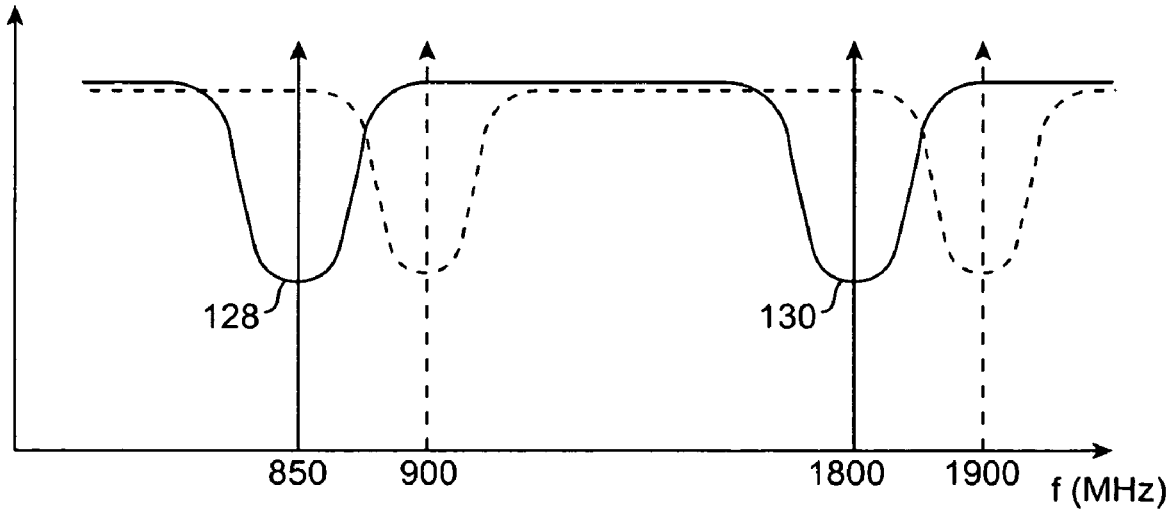
FIG. 37 is a diagram showing the return loss of an illustrative radiating element versus frequency as the switching circuitry of FIG. 36 selects between each of the two different antenna feeds in accordance with the present invention.

An example of an arrangement that may be used to cover four bands (e.g., the four GSM bands) using a two port antenna is shown in FIG. 36. Diplexers 124 are used to couple RF transceiver 114 to switching circuitry 116. One diplexer 124 handles the 850 MHz and 1800 MHz bands while the other diplexer 124 handles the 900 MHz and 1900 MHz bands. A graph showing the placement of each of the bands is shown in FIG. 37. The antenna is designed to have a fundamental operating frequency range 128 at about 850 MHz and a harmonic operating frequency range 130 at about 1800. When switch SW1 is on and switch SW2 is off, feed1 is active and the antenna's response is as shown by the solid line in FIG. 37. The antenna has a narrow bandwidth that covers a single band at each resonant frequency.

As shown by the solid line in FIG. 37, when feed1 is used, the antenna can cover both the 850 MHz and 1800 MHz bands. When it is desired to tune the antenna, switches 116 are adjusted so that feed2 is used. This shifts both the fundamental operating range 128 and the harmonic operating frequency range 130 to higher frequencies, so as to cover the 900 MHz and 1900 MHz bands, respectively, as shown by the dashed line in FIG. 37.

Figure 38:
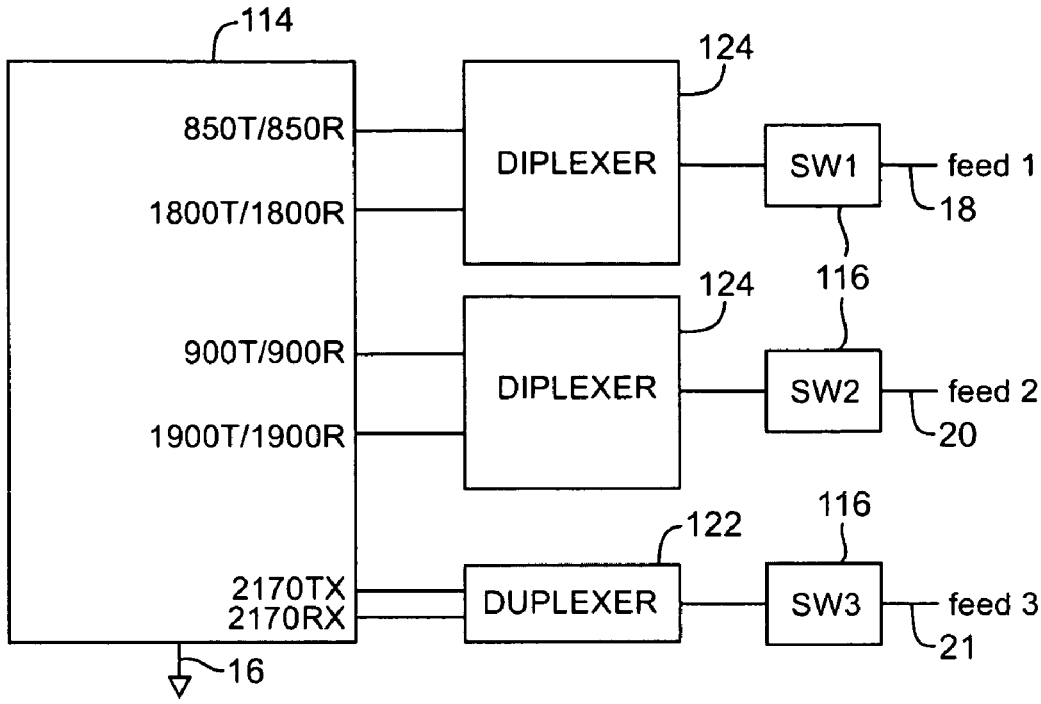
FIG. 38 is a diagram showing how an illustrative RF transceiver integrated circuit with five bands can be selectively connected to three different antenna feeds using two diplexers and a duplexer in accordance with the present invention.
Figure 39:
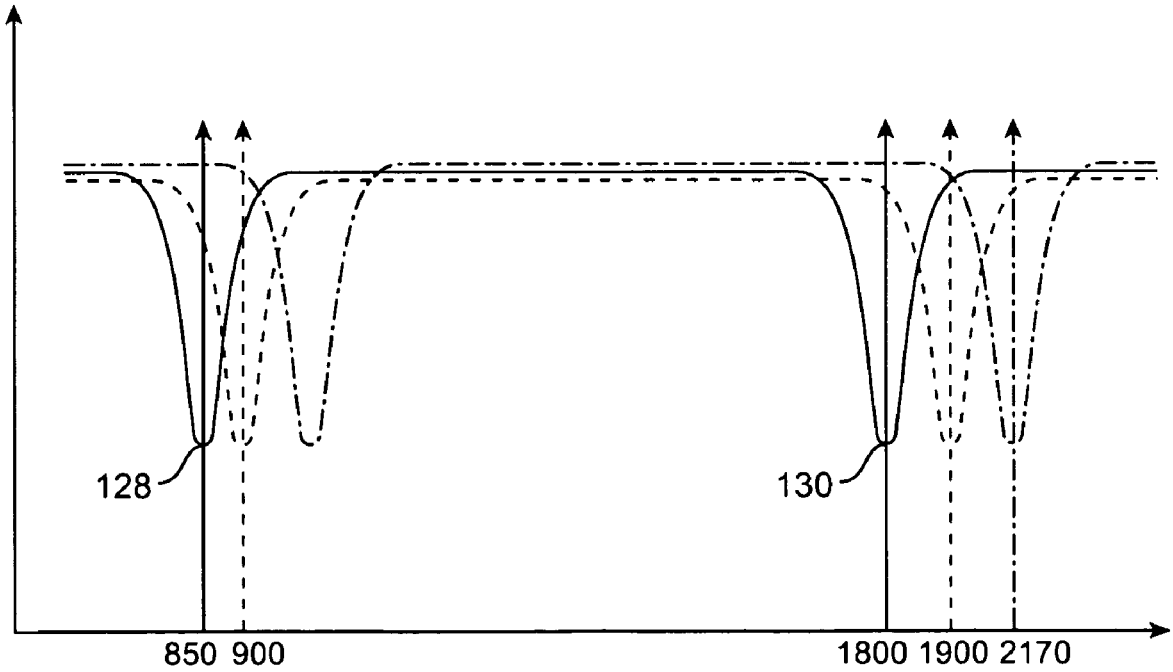
FIG. 39 is a diagram showing the return loss of an illustrative radiating element versus frequency as the switching circuitry of FIG. 38 selects between each of the three different antenna feeds in accordance with the present invention.

An example of an arrangement that may be used to cover five bands (e.g., the four GSM bands and the UMTS band) using a three port antenna is shown in FIG. 38. Diplexers 124 are used to couple RF transceiver 114 to switching circuitry 116. One diplexer 124 handles the 850 MHz and 1800 MHz bands while the other diplexer 124 handles the 900 MHz and 1900 MHz bands. The placement of each of the bands is shown in the graph of FIG. 39. When feed1 is used, the antenna is has a fundamental operating frequency range 128 at about 850 MHz and a harmonic operating frequency range 130 at about 1800 MHz. When switch SW1 is on and switches SW2 and SW3 are off, feed1 is active and the antenna's response is as shown by the solid line in FIG. 39.

As shown by the solid line in FIG. 39, when feed1 is used, the antenna covers both the 850 MHz and 1800 MHz bands. Due to the relatively narrow bandwidth of the antenna, adjacent bands are not covered without tuning. When it is desired to tune the antenna to cover the 900 MHz and 1900 MHz bands, switches 116 are adjusted so that feed2 is used. This shifts both the fundamental operating range 128 and the harmonic operating frequency range 130 to higher frequencies, so as to cover the 900 MHz and 1900 MHz bands, respectively, as shown by the dashed line in FIG. 39.

When it is desired to tune the antenna to cover the 2170 MHz band, switches 116 are adjusted so that feed3 is switched into use. As a result, the fundamental operating range 128 and the harmonic operating frequency range 130 are shifted to higher frequencies. With this antenna tuning configuration, the harmonic operating frequency range 130 covers the 2170 MHz band, as shown by the dot-and-dashed line in FIG. 39.

Figure 40:
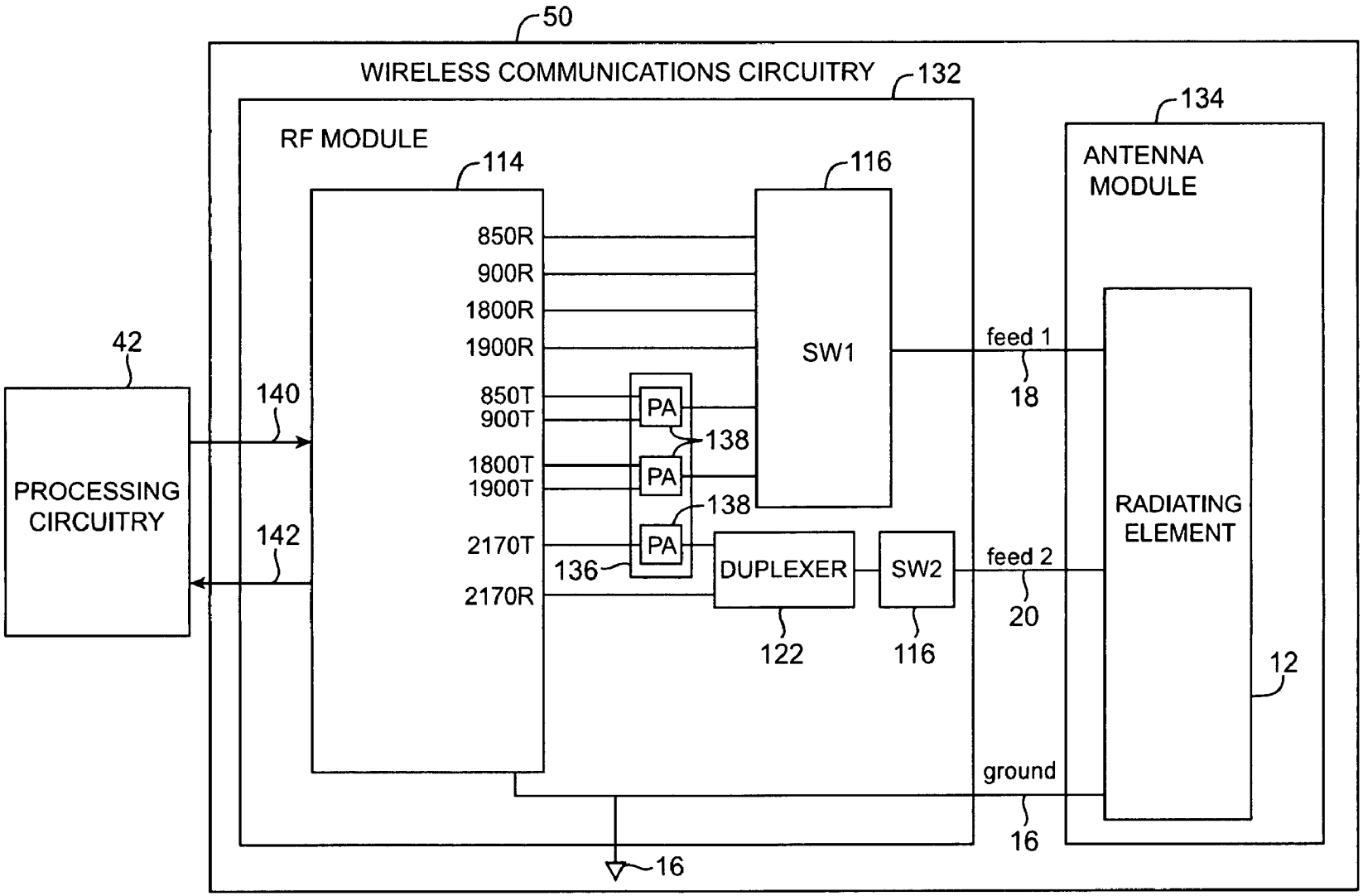
FIG. 40 is a diagram of illustrative handheld electronic device circuitry including control circuitry that transmits and receives data, an RF module containing an RF transceiver integrated circuit and switching circuitry, and an antenna module having a multi-feed radiating element in accordance with the present invention.

FIG. 40 shows details of an arrangement of the type described in FIG. 34 in which five bands are covered (e.g., the four GSM bands and the UMTS band) using two antenna ports.

Processing circuitry 42 can generate data to be transmitted and can provide this data to RF module 132 in wireless communications circuitry 50 using a path such as path 140. Data that is received by the handheld device may be routed from RF module 132 to processing circuitry 42 via path 142. Transceiver 114 can be coupled to radiating element 12 in antenna module 134 via feed1, feed2, and ground. Switching circuitry 116 can be used to regulate which antenna port is active. Switch SW1 can be used to select a desired GSM signal path to connect to feed1 when feed1 is active and is used to disconnect feed1 from the RF transmitter when feed1 is inactive. Switch SW2, which is on when switch SW1 is inactive, can used to seletively activate feed2. Switch SW2 can receive transmitted signals from RF transceiver 114 and can deliver received signals to RF transceiver 114 through duplexer 122, which can handle the transmit and receive subbands for a 2170 MHz UMTS band.

A power amplifier integrated circuit 136 may be used to boost outgoing signal levels. Power amplifier integrated circut 136 contains power amplifiers 138. The power amplifiers may be provided as separate integrated circuits if desired.

Figure 41:
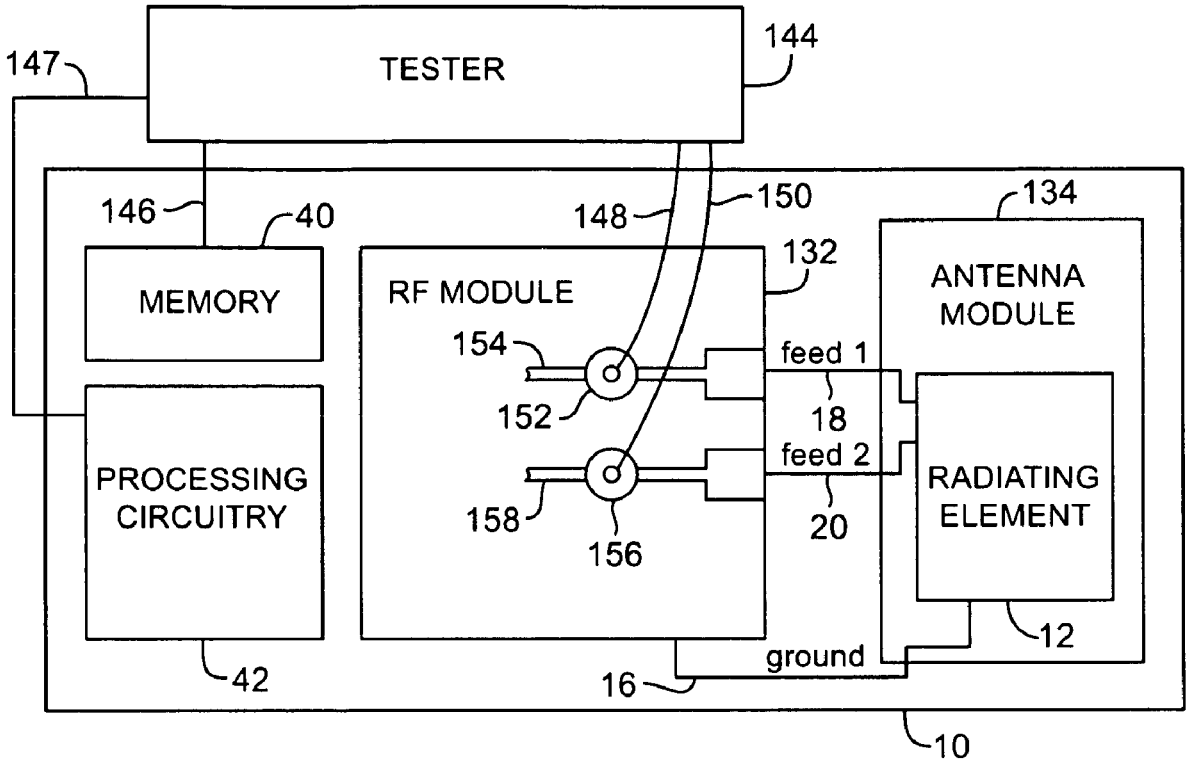
FIG. 41 is a diagram showing how an illustrative tester can be used to calibrate a circuit board containing a multi-feed antenna in accordance with the present invention.

A testing arrangement that may be used to calibrate an RF module 132 during the process of manufacturing a handheld device 38 is shown in FIG. 41. During testing, tester 144 can apply power and control signals to processing circuitry 42 using a path such as path 147. The control signals may direct the processing circuitry 42 to transmit signals to antenna module 134. Each feed can be calibrated in turn. Tester 144 has a cable and test probe that can be connected to either RF switch connector 152 (when the cable and probe are in the position indicated by line 148) or RF switch connector 156 (when the cable and probe are in the position indicated by line 150). During testing, the probe taps into the signals that would otherwise be transmitted over antenna module 134.

Figure 42:
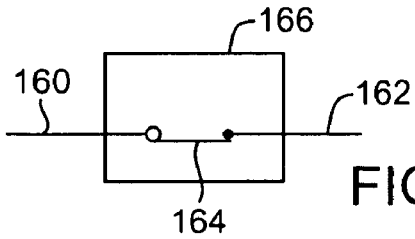
FIG. 42 is a cross-sectional side view of an illustrative RF switch connector for an RF module when the RF module is in normal operation in accordance with the present invention.
Figure 43:
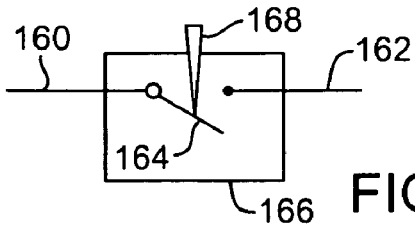
FIG. 43 is a cross-sectional side view of an illustrative RF switch connector for an RF module when the RF module is being calibrated using a test probe in accordance with the present invention.

RF switch connectors 152 and 156 have two operating conditions. A cross-section of an illustrative RF switch connector 166 is shown in FIGS. 42 and 43. When no test probe is inserted, as shown in FIG. 42, input 160 is connected to output 162 via conductor 164. When the tip of a test probe 168 is inserted into switch connector 166, conductor 164 is pressed downwards, which opens the circuit between conductor 164 and output 162 and electrically connects input 160 to the test probe 168.

RF switch connector 152 may be used to tap into signals that would normally pass from data path 154 to feed1, whereas RF switch connector 156 may be used to tap into signals that would normally pass from data path 158 to feed2. During calibration, tester 144 measures the signal strenth received on each feed for a variety of output power settings. Using curve fitting techniques, tester 144 determines which calibration settings should be stored in the circuitry 10. The calibration settings are loaded into non-volatile memory 40 such as flash memory over a path such as path 146. Later, during normal operation, processing circuitry 42 uses the stored calibration settings to make calibrating adjustments to the output signal levels of the RF module 132.

Figure 44:
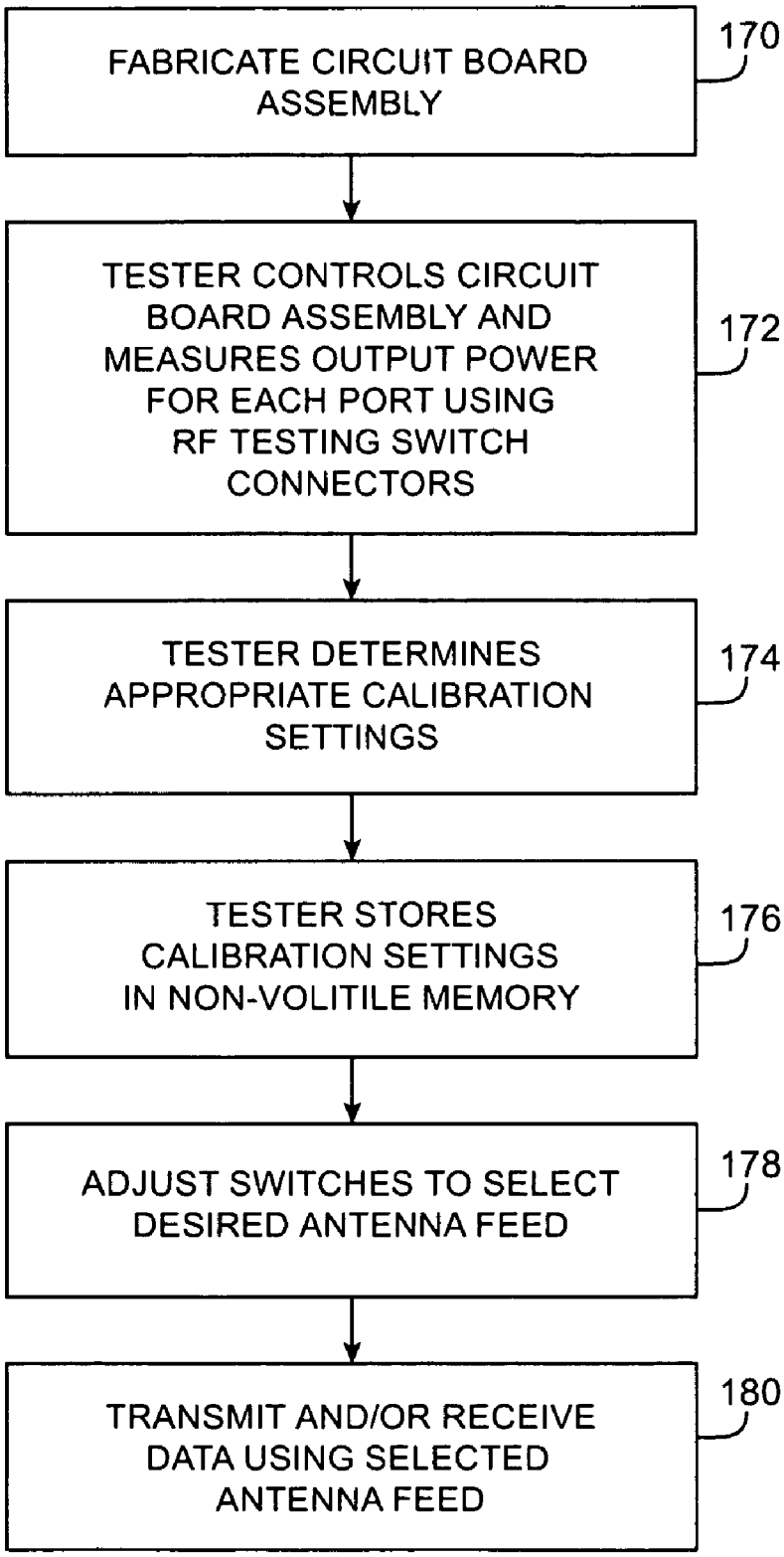
FIG. 44 is a flow chart of illustrative steps involved in calibrating and using a handheld electronic device having a multi-feed antenna in accordance with the present invention.

Illustrative steps involved in testing and fabricating handheld devices with tunable multi-port antennas are shown in FIG. 44.

At step 170, a circuit board assembly containing the RF moudule 132 and antenna module 134 can be fabricated.

At step 172, tester 144 of FIG. 41 may send control signals to processing circuitry 42 via path 147. The control signals direct the processing circuitry 42 to use transceiver 114 and switching circuitry 116 to transmit suitable test signals to the antenna on feeds 18 and 20. Each feed is excercised separately. To ensure accurate measurements, test signals may be transmitted using several different power settings while tester 144 gathers associated test measurements.

At step 174, the tester 144 can process the test measurements (e.g., using curve-fitting routines) and generates corresponding calibration settings. The calibration settings indicate what adjustments need to be made by RF module 132 during normal operation to ensure that the transmitted RF power levels are accurate.

The tester 144 can store the calibration information in memory 40 at step 176. With one suitable arrangement, the calibration information is stored in a non-volatile memory such as a flash memory to ensure that the calibration information will be retained in the event of a loss of power by the handheld electronic device 38.

During steps 178 and 180, the handheld electronic device 38 may be used by a user to place cellular telephone calls, to upload or download data over a 3G link, or to otherwise wirelessly transmit and receive data.

During step 178, the processing circuitry 42 (FIG. 41) retrieves the calibration settings data from memory 40 and uses the retrieved calibration settings to adjust the power output of the handheld device so that the output power is calibrated. The processing circuitry 42 calibrates each port separately, so the output power is accurate regardless of which antenna port is being used.

During step 180, the user can transmit and receive data using the antenna. The processing circuitry 42 tunes the antenna as needed by selecting an appropriate antenna feed using switching circuitry 116.

The foregoing is merely illustrative of the principles of this invention and various modifications can be made by those skilled in the art without departing from the scope and spirit of the invention.

What is claimed is:

1. A tunable multipart handheld electronic device patch antenna, comprising:

a ground terminal;

a substantially planar radiating element located above the ground terminal that is electrically connected to the ground terminal; and at least first and second antenna feeds, wherein the first antenna feed is electrically connected to the radiating element at a first location, wherein the second antenna feed is electrically connected to the radiating element at a second location that is different from the first location, wherein the first antenna feed and the ground terminal form a first antenna port through which antenna signals are transmitted and received, and wherein the second antenna feed and the ground terminal form a second antenna port through which antenna signals are transmitted and received.

2. The tunable multiport handheld electronic device patch antenna defined in claim 1 wherein the substantially planar radiating element and ground terminal form a planar-inverted-F antenna (PIFA) structure and wherein the first and second antenna feeds form feeds for the PIFA structure.

3. The tunable multiport handheld electronic device patch antenna defined in claim 2 wherein the radiating element comprises a metal antenna structure without adjustable capacitive loading.

4. The tunable multiport handheld electronic device patch antenna defined in claim 2 wherein the radiating element comprises first, second, and third integral elongated portions, wherein the first elongated portion forms the ground terminal, wherein the second elongated portion forms the first feed, and wherein the third elongated portion forms the second feed.

5. The tunable multiport handheld electronic device patch antenna defined in claim 2 wherein the radiating element comprises metal and is configured to operate at a frequency range associated with a first cellular telephone band when the first antenna port is used and is configured to operate at a frequency range associated with a second cellular telephone band that is different from the first cellular telephone band when the second antenna port is used.

6. The tunable multiport handheld electronic device patch antenna defined in claim 5 wherein selecting between the first port and second port occurs without the use of adjustable capacitive loading, and wherein the first and second cellular telephone bands are selected from the group consisting of an 850 MHz band, a 900 MHz band, an 1800 MHz band, a 1900 MHz band, and a 2170 MHz band.

7. Tunable multiport antenna circuitry comprising:

a substantially planar radiating element;

a circuit board having a ground conductive path and first and second antenna feed conductive paths;

a ground electrical connecting structure that connects the ground conductive path to the radiating element and serves as a ground terminal for the radiating element;

a first feed electrical connecting structure that electrically connects the first feed conductive path on the circuit board to the radiating element at a first location and serves as a first feed terminal for the radiating element, wherein the first feed terminal and the ground terminal form a first antenna port through which antenna signals are transmitted and received; and a second feed electrical connecting structure that electrically connects the second feed conductive path on the circuit board to the radiating element at a second location distinct from the first location and serves as a second feed terminal for the radiating element, wherein the second feed terminal and the second ground terminal form a second antenna port through which antenna signals are transmitted and received.

8. The tunable multiport circuitry defined in claim 7 wherein at least one of the ground electrical connecting structure, the first feed electrical connecting structure, and the second feed electrical connecting structure comprises a spring-loaded pin.

9. The tunable multiport circuitry defined in claim 7 wherein at least one of the ground electrical connecting structure, the first feed electrical connecting structure, and the second feed electrical connecting structure comprises a piece of bent conductor that serves as a spring.

10. The tunable multiport circuitry defined in claim 7 wherein at least one of the ground electrical connecting structure, the first feed electrical connecting structure, and the second feed electrical connecting structure comprises a piece of bent conductor formed as an integral part of the radiating element that serves as a spring and that is soldered to one of the conductive paths on the circuit board.

11. The tunable multiport circuitry defined in claim 7 wherein the circuit board has a third feed conductive path, the circuitry further comprising:

a third feed electrical connecting structure that electrically connects the third feed conductive path on the circuit board to the radiating element at a third location distinct from the first and second locations and that serves as a third feed terminal for the radiating element.

* * * * *

UNITED STATES PATENT AND TRADEMARK OFFICE

CERTIFICATE OF CORRECTION

PATENT NO. : 7,671,804 B2
APPLICATION NO. : 11/516433
DATED : March 2, 2010
INVENTOR(S) : Zhijun Zhang et al.

It is certified that error appears in the above-identified patent and that said Letters Patent is hereby corrected as shown below:

In column 14, line 3, delete “seletively” and insert -- selectively --, therefor.

In column 14, lines 9-10, delete “circut” and insert -- circuit --, therefor.

In column 14, line 38, delete “strenth” and insert -- strength --, therefor.

In column 14, line 51, delete “moudule” and insert -- module --, therefor.

In column 15, line 25, in Claim 1, delete “multipart” and insert -- multiport --, therefor.

Signed and Sealed this
Sixth Day of December, 2011

David J. Kappos

David J. Kappos
*Director of the United States Patent and Trademark Office*